United States Patent [19]

Linder

[11] 4,240,278

[45] Dec. 23, 1980

[54] GATE LOCKING DEVICE

[76] Inventor: Peter J. Linder, 3109 Ramblewood Rd., Ellicott City, Md. 21043

[21] Appl. No.: 959,157

[22] Filed: Nov. 9, 1978

[51] Int. Cl.[3] ..... E05B 65/06

[52] U.S. Cl. ..... 70/101; 49/394; 70/56; 292/205; 292/216

[58] Field of Search ..... 70/77, 101, 56, DIG. 63; 292/198, 205, 216, 304, DIG. 29; 49/394

[56] References Cited

U.S. PATENT DOCUMENTS

| | | | |
|---|---|---|---|
| 1,896,909 | 2/1933 | Maxwell | 292/216 X |
| 2,577,930 | 12/1951 | Thomas | 292/216 X |
| 2,587,167 | 2/1952 | Kelley | 49/394 X |
| 2,666,660 | 1/1954 | Youngworth | 292/205 X |
| 2,707,125 | 4/1955 | Ritter, Sr. | 70/77 X |
| 2,856,220 | 10/1958 | Easley | 70/56 X |
| 2,986,829 | 6/1961 | Myers | 49/394 |
| 3,282,617 | 11/1966 | Wason | 49/394 X |
| 3,926,018 | 12/1975 | Joersz | 70/77 X |

*Primary Examiner*—William E. Lyddane

*Attorney, Agent, or Firm*—Browdy and Neimark

[57] ABSTRACT

A locking mechanism for a horizontally swinging gate bar, for locking the end of the bar to a vertical post. The vertical post has a cap member threadedly mounted eccentrically thereon, said cap member having a cavity to receive the end of the gate bar. The cap member contains a locked linkage, one of whose links includes a locking projection engaging in a slot in the post, whereby to lock the cap member in a non-rotatably held condition lockingly receiving the end of the gate bar. The linkage includes pivotal connections formed by the shackles of padlocks. By removing at least one of the padlocks the linkage can be disconnected to allow withdrawal of the locking projection from the post slot, to thereby allow the cap member to be rotated sufficiently to enable the end of the gate bar to be swung out of the locking cavity. A stop member depending from the floor of the cavity cooperates with a horizontal lug in the post to prevent unscrewing of the cap member from the post.

11 Claims, 9 Drawing Figures

GATE LOCKING DEVICE

FIELD OF THE INVENTION

This invention relates to gate locking devices, and more particularly to a locking mechanism for a horizontally-swinging barrier gate.

BACKGROUND OF THE INVENTION

Various types of vehicle-resistant barrier gates have been employed to control the entry of vehicles into parking enclosures, or the like, or to control the passage of vehicles along roadways leading to restricted areas, such as parks, recreational areas, or other locations where there is restricted entry.

The locking mechanisms previously employed with such barrier gates have various disadvantages, such as requiring careful adjustment, being subject to rapid deterioration from adverse weather conditions, being expensive to fabricate or install, being vulnerable to tampering or theft, being usable only with gates swingable in one direction, being subject to frequent mechanical failure, being complicated in construction, and being difficult to operate.

One prior art device permitting the use of multiple locks for gates has been devised by the Pennsylvania Game Commission. This device uses a fabricated metallic box at the upper end of the gate post, which box is adapted to receive the end of the gate. The box has a hinged top through which access is gained. When the end of the gate is positioned within a horizontal opening in the box, a pin is then placed downwardly through openings in the end of the gate. The pin can either be maintained in place by two padlocks, one at the top and another at the bottom, or horizontal pins can be placed through the vertical pin in which case each of the two horizontal pins may then be held in place by two padlocks, thereby giving this device the capability of utilizing four padlocks.

The U.S. Forest Service, in a facility in Michigan, has used a gate lock wherein the gate post is merely provided with a horizontally extending bar capable of mating with a slot in the end of the gate. The end of the bar is provided with a removable pin through which a padlock may then be passed.

Another system is the type of pipe gate used on International Paper Company lands located east of Maine Route 27, north of Kingsfield, Maine. This device is somewhat similar to that shown in the Easley U.S. Pat. No. 2,856,220, discussed below. In this particular system, the gate post is provided with an element having top and bottom portions and into which the end of the gate is swung. With the gate then in position, a pin is dropped through the top part of the element, then through the end of the gate and then through the bottom element, which bottom element provides shielding for a padlock which locks through the bottom end of the pin. The bottom element of this device is shaped somewhat like the covered gate head 13 of the Easley patent. Other devices also exist of a somewhat similar nature, but constructed so as to permit the gate to be opened either way by passing entirely through the gate receiving element mounted on the gate post.

Possibly the most sophisticated gate locking mechanism heretofore provided is one recently designed by the U.S. Forest Service which uses multiple locking; square-tubing to repel pipe cutters; and is adjustable in length in the field without welding. In this device a box is provided at the upper end of the gate post. However, once again, as with devices discussed above, a vertical pin is passed through the end of the gate and the box and means are provided for a multiple lock mechanism in conjunction with the vertical pin.

The Ritter U.S. Pat. No. 2,707,125 shows a locking gate mechanism having a recessed post, with a horizontal locking bar slidably movable into the recess, the opening of which is controlled on the gate post. The device uses multiple locks and is quite sophisticated and complex in some regards. However, it is expensive and the locks are not shielded.

The Myers U.S. Pat. No. 2,986,829 is somewhat similar to the Ritter patent in that it also shows a gate locking mechanism having a recessed post, with a horizontal locking bar slidably movable by a lever pivoted on the gate.

The Wason U.S. Pat. No. 3,282,617 discloses a gate locking device wherein a padlock is employed to restrain the raising of a locking plunger. Kelley, U.S. Pat. No. 2,587,167 shows a gate latch having a horizontal spring-biased bolt engaging the sides of a recess in the adjacent post.

Also known is a fence gate locking device having a U-shaped locking element on the gate post which pivots side-to-side on a vertical axis to grasp the fence gate, and then drops downwardly when alignment is correct into a slot through which a padlock can be passed. One such device of this type is believed to be marketed by Page Fence Company.

A problem with the devices mentioned above which use vertical pins is that water will run down the vertical pin and in cold weather will freeze, thereby freezing the locks and preventing convenient unlocking of the locks when desired.

Another device available is a device known as the "Security gate kit for controlling access". The locking portion of this device is not believed to utilize any rotating members and the device is believed to suffer from many of the deficiencies noted above.

The device of the Easley U.S. Pat. No. 2,846,220 is, in some respects, a superior design. However, this structure does have points of weakness which may be attacked, such as the horizontal pin 14. It utilizes no rotating members and is limited in the number of locks utilizable; also, where more than one lock is desired, such as in the FIG. 6 embodiment, a separate protective enclosure is necessary for each lock.

Also of interest is the Linder U.S. Pat. No. 3,990,182, which relates to a locking device utilizing a stretched cable, rather than a swing gate.

SUMMARY OF THE INVENTION

Accordingly, a main object of the present invention is to overcome the deficiencies and disadvantages of the barrier gate locking devices previously employed.

A further object of the invention is to provide a novel and improved locking mechanism for a barrier gate of the horizontally swinging type which is relatively simple in construction, which is easy to install, which is durable, and which cannot be easily tampered with or stolen.

A still further object of the invention is to provide an improved locking assembly for a barrier gate which is substantially fully protected from the weather, which is effectively shielded against tampering, which can be easily unlocked by authorized persons, and which can be readily installed on the top end of an associated securing post.

A still further object of the invention is to provide an improved locking mechanism for gates of the single swinging barrier type, which involves relatively few parts, which is protected against theft, and which employs a minimum number of parts requiring special hardening treatment.

A still further object of the invention is to provide an improved gate locking mechanism for a single swinging barrier which does not require any fine adjustments, which is usable with gates swinging in both directions, which can be employed optionally with one or more padlocks, which can be readily adapted for use with existing pipe gates of various types, which is effectively protected against damage from weather or from tampering, and which is composed of relatively durable, yet inexpensive, parts.

A still further object of the invention is to provide an improved gate locking mechanism employing a cap or dome-like member which protectively houses the locking mechanism and the associated padlocks and which allows key access to the padlocks from below, and which is provided with a locking cavity loosely receiving the end of an associated horizontally swinging barrier, the cap member being preferably eccentrically rotatably mounted and being lockable in an extended barrier-receiving position and held against rotation by the padlocks, being rotatable to release the barrier only by the removal of at least one of the padlocks, thus preventing opening of the barrier by unauthorized persons, and having concealed means to prevent removal of the mechanism from its associated supporting post when it is in an unlocked condition.

BRIEF DESCRIPTION OF THE DRAWINGS

Further objects and advantages of the invention will become apparent from the following description and claims, and from the accompanying drawings, wherein:

DESCRIPTION OF A PREFERRED EMBODIMENT

Figure 1:
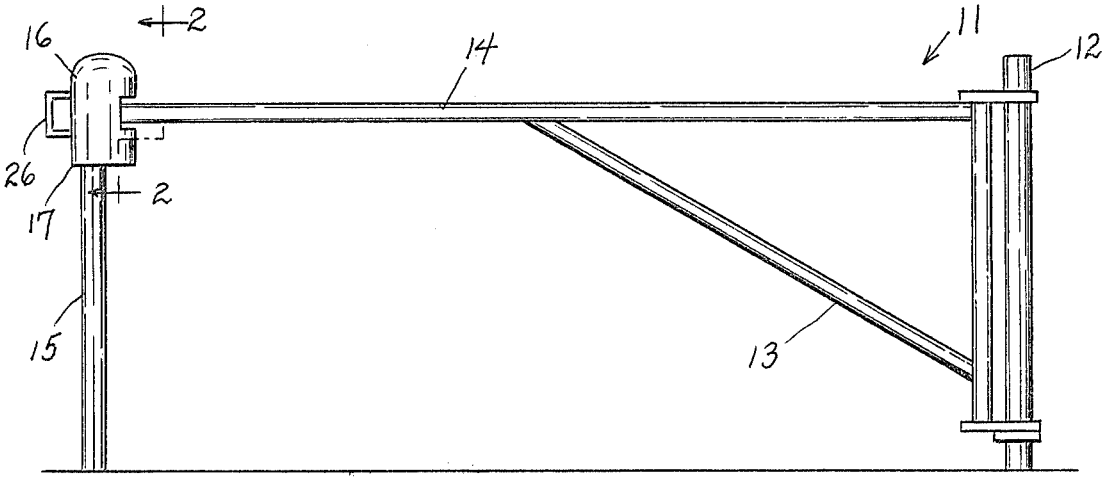
FIG. 1 is an elevational view of a barrier gate assembly provided with an improved locking mechanism according to the present invention, shown in a locked-gate condition.

Referring to the drawings, FIG. 1 illustrates a typical swinging gate assembly, designated generally at 11, of the type comprising a vertical gate supporting post 12, of tubular metal, or the like, on which is rotatably supported a swinging gate 13 having a horizontal top barrier bar 14 horizontally swingable relative to an opposite stationary vertical gate post 15, likewise of tubular metal. The swinging end of the barrier bar 14 is lockingly interengageable with a gate locking device 16 which is mounted on the top end of gate post 15.

Gate locking device 16 comprises a generally cylindrical cap member 17, open at its bottom end and provided with a dome-shaped top 18. At one side the cap member has a generally rectangular aperture 19 exposing a cavity 20 defined by a bottom horizontal wall disc 22 and spaced, parallel vertical side walls 23, 23, and an optional top plate 21, all rigidly secured, such as by welding, in the cylindrical main body portion of cap member 17 at the edges of aperture 19.

Figure 2:
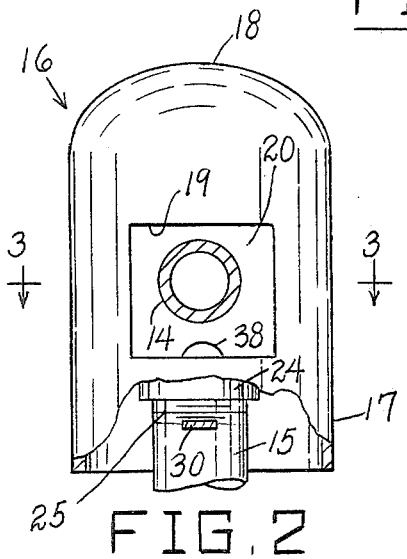
FIG. 2 is an enlarged vertical cross-sectional view taken substantially on line 2—2 of FIG. 1.
Figure 3:
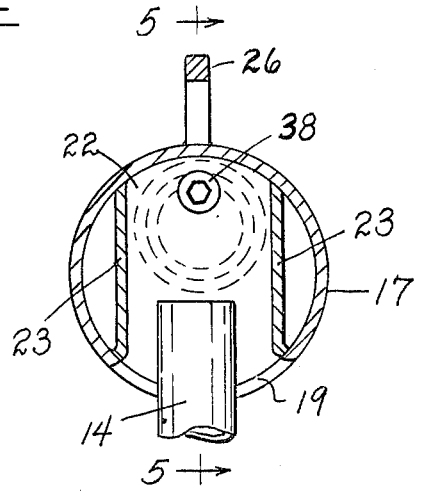
FIG. 3 is a horizontal cross-sectional view taken substantially on line 3—3 of FIG. 2.
Figure 4:
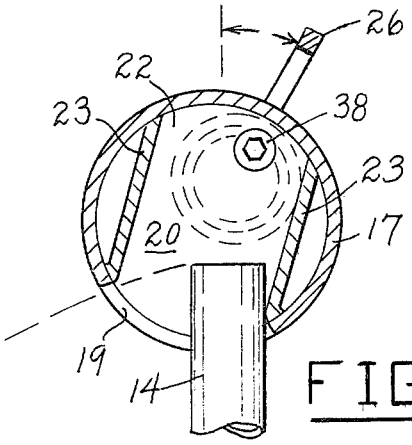
FIG. 4 is a horizontal cross-sectional view similar to FIG. 3, showing the mechanism in a gate-opening position.
Figure 5:
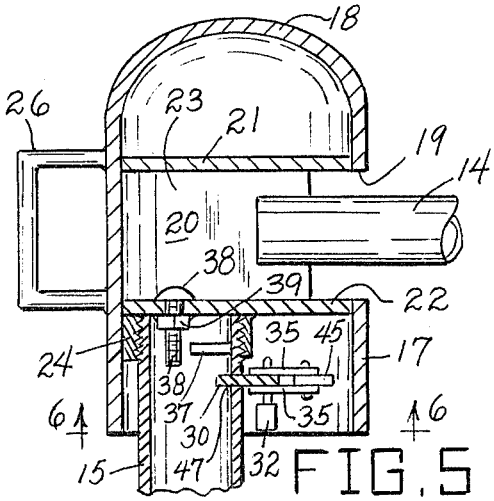
FIG. 5 is a vertical cross-sectional view taken substantially on line 5—5 of FIG. 3.

Welded to the bottom surface of horizontal disc 22 is a depending internally threaded coupling sleeve member 24 located adjacent to the inside surface of the cylindrical body of cap member 17 so as to define an eccentrically-positioned rotational support for the cap member. While in the illustrated embodiment the coupling sleeve 24 is mounted diametrically opposite the aperture 19, it will be understood that it can be placed directly under the aperture 19 with consequent other minor changes in structure. The sleeve member 24 is threadedly engaged with external threads 25 provided on the top end of gate post 15, as shown in FIGS. 2 and 5. The cap member 17 is thus eccentrically rotatable on the gate post 15, being rotatably supported by the interengaging threads of sleeve member 24 and gate post 15. The swinging free end of barrier bar 14 is receivable in the cavity 20 and can be loosely locked therein when the cap member 17 is in its position of maximum extension toward the opposite gate post 12, namely, in the position of FIG. 3. However, when the cap member 17 is rotated about 45° away from its position of maximum extension, in either direction, for example as shown in FIG. 4, sufficient clearance is provided to allow the end of the barrier bar 14 to swing out of the cavity 20, allowing the gate to be opened. The cap member 17 may be provided with a vertical gripping handle 26 opposite the aperture 19 to facilitate manual rotation of the cap member 17.

Figure 6:
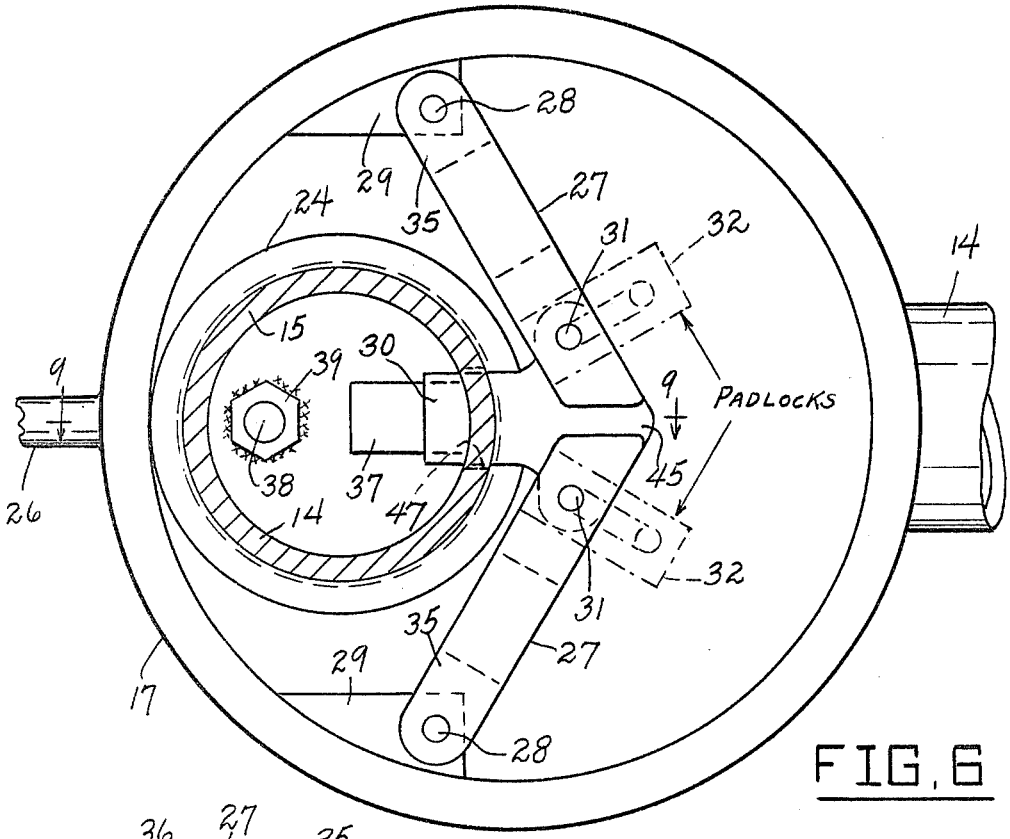
FIG. 6 is an enlarged horizontal cross-sectional bottom view taken substantially on line 6—6 of FIG. 5.
Figure 7:
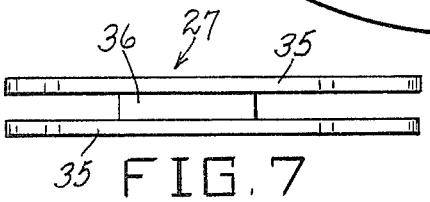
FIG. 7 is a side elevational view of one of the side links employed in the gate-locking linkage shown in FIG. 6.
Figure 8:
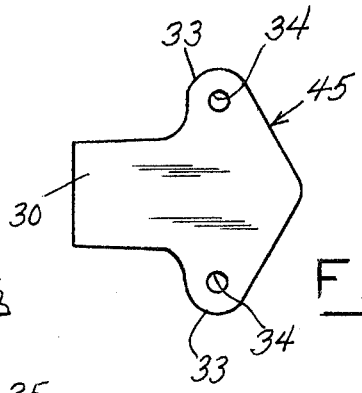
FIG. 8 is a plan view of the central locking lug-carrying link forming part of the locking linkage of FIG. 6.
Figure 9:
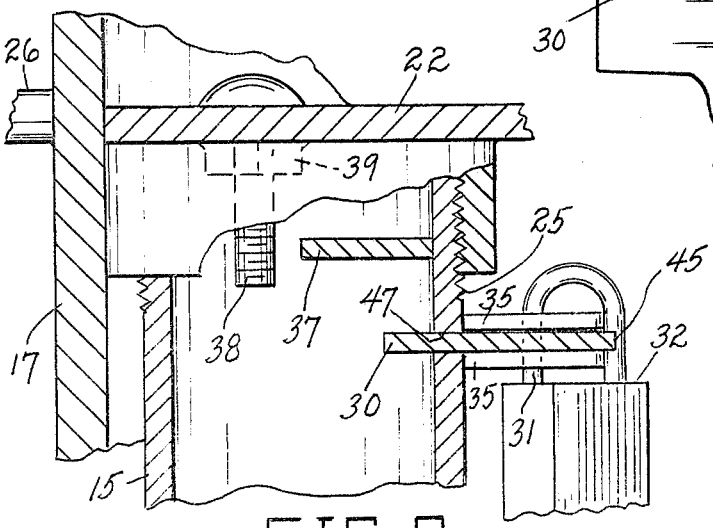
FIG. 9 is a fragmentary vertical cross-sectional view taken substantially on line 9—9 of FIG. 6.

A locking means is provided for locking the gate, such locking means being shown in detail in FIGS. 6 to 9. Subjacent to the threads 25 the gate post 15 is formed with a horizontal slot 47 located directly below the mouth 19 of the cap member 17 as shown in FIG. 5. A three-part locking linkage is provided, comprising a pair of side link members 27, 27, preferably of hardened steel, pivotally connected at 28, 28 to respective opposite triangular lugs 29, 29 rigidly secured, such as by welding, in cap member 17; and a central link member 45 also preferably of hardened steel, formed with a locking tongue 30 loosely engageable in the slot 47, as shown in FIGS. 6 and 9. The connections of link member 45 to side links 27, 27, shown at 31, 31, comprise the removable shackles of respective conventional padlocks 32, 32, receivable in the bottom cavity of cap member 17 and accessible from below the cap member.

As shown in FIG. 8, the central link member 45 is generally T-shaped and has the opposite side lugs 33, 33 formed with apertures 34, 34 for the shackles 31, 31 of the padlocks. The side links 27 each comprise a pair of spaced parallel bar elements 35, 35 rigidly connected by an intervening spacer block 36, as shown in FIG. 7. The fixed lugs 29, 29 are received between the ends of the bars 35, 35 at the outer ends of the links 27, 27 and the side lugs 33, 33 of the central link 45 are received between the ends of the bars 35, 35 at the inner ends of the links 27, 27. The bars 35 are apertured at their opposite ends to register with corresponding apertures in the fixed lugs 29 and the apertures 34 of the central link 29.

If so desired, padlocks may be employed at the outer link connections 28, 28 in lieu of or in addition to the padlocks 32 at the inner link connections of the side links 27. Thus, from one to four padlocks may be employed. Conventional pin connections of a permanent nature may be used for the link connections not provided by padlock shackles.

When the locked linkage is disconnected by removing one padlock at any of the four possible padlock positions, the locking tongue 30 may be withdrawn from the post slot 47, permitting rotation of the cap member 17 to a position such as is shown in FIG. 4, to allow the gate to be opened. Opening of the gate can be in either direction. However, rotational movement of the cap member in either direction is limited to approximately 180° to prevent removal thereof from the post 15 by the provision of a horizontal radial stop lug 37 rigidly secured in the gate post 15 above the slot 47, engageable with a depending projection 38 provided on the cavity floor member 22 diametrically opposite to the aperture 19 and extending into the top end of post 15 on the opposite side of the vertical rotational axis relative to aperture 19. This projection may comprise a continuously threaded button head socket screw 38 extending through floor member 22 and threadedly engaging a nut 39 welded to the bottom surface of member 22.

By limiting the rotational movement of the cap member 17 while the gate is in open position, theft of the gate locking device is made relatively difficult. If so desired, a rigidly-secured depending stop pin element may be employed instead of the adjustable socket screw 38.

In locking the gate, the bar 14 is swung from its open position toward the post 15. The cap member 17 is placed in a position angled to receive the end of bar 14 in cavity 20, as in FIG. 4, and the end of the bar 14 is swung so as to enter said cavity 20. The cap member 17 is then brought to the position of FIG. 3 and the link member 45 is manually moved so that tongue member 30 is engaged through slot 47 to substantially the position of FIG. 6. Assuming a padlock to have been removed from a position shown in FIG. 6, the free link member 27 is then rotated inwardly to a position such that the free lug 33 of link 45 is received between the inner ends of the bars 35, 35 of said free link member 27, and the aperture 34 of said free lug 33 is brought into registry with the apertures of the inner ends of said bars 35, 35. The shackle 31 of a padlock 32 is then engaged through the registering apertures and is locked in the padlock in the conventional way. This locks the linkage comprising the links 27, 45, 27 and holds the tongue member 30 in the slot 47, preventing rotation of cap member 17 relative to post 15. In the locked position of FIG. 3, the end of the barrier bar 14 is loosely received in the cavity 22, but removal therefrom is prevented because it cannot move past the side walls 23, 23 of cavity 22.

The padlocks 32 are housed in and suspended in the lower portion of cap member 17 and are not visible from the outside. To remove a padlock, its key is inserted therein from below and turned to release its shackle, which then can be disengaged from its associated link members to disconnect the linkage and allow tongue member 30 to be retracted from slot 47 so that the cap member can be rotated sufficiently to disengage the barrier bar from cavity 20.

while many of the advantages of the instant invention have been pointed out above, it should be noted that the present device solves many problems. The gate locking device is quite sophisticated but inexpensive to construct, in part because the elements are few and only small parts need to be hardened. The cap member may be made of 8-inch pipe to which a common tank head or dome may be welded to form the dome-shaped top. The depending internally threaded coupling sleeve may be formed of one-half of a common threaded 4-inch pipe coupling.

Moreover, the device is very forgiving in the sense that fine adjustments are not needed and when the device is made of components of size as indicated immediately above, there are about 3 inches of play. The gate operates in either direction and is extremely hard to break into. The padlocks are protected from weather and the unhardened parts of the device are shielded by the hardened elements from below. Additionally, the device can be retrofitted to existing pipe gates of various types.

While a specific embodiment of an improved gate locking device has been disclosed in the foregoing description, it will be understood that various modifications within the scope of the invention will occur to those skilled in the art. For example, the device of the present invention can be used in conjunction with a normal, commercial chain-link fence gate by welding a horizontal stud or bar on the gate and using such stud in conjunction with the present invention in the same manner as the tip of the barrier bar 14. If the cap member 17 is of sufficiently larger diameter, e.g. 10" diameter, than the post 15, the cap member 17 may be disposed concentric to, rather than eccentric to (as is preferred), the post 15. Also, in place of coupling sleeve 24, the device can use a large vertical bolt welded to the horizontal disc 22, with a receiving nut being welded to the gate post 15; or a straight axle and drive pin method of fastening the cap 17 to the post 15 for rotation thereon could also be used. The positions of the radial stop lug 37 and the depending projection 38 can also be moved from the positions illustrated. Therefore, it is intended that adaptations and modifications should and are intended to be comprehended within the meaning and range of equivalents of the disclosed embodiment.

What is claimed is:

1. A gate locking device comprising: a cap member having a side opening defined by side walls and adapted to restrictively receive the end of a horizontally swinging gate bar, said cap member defining a protected chamber at a level below the level of said side opening and separated therefrom by wall means, said cap member being open at the bottom to provide egress to the protected chamber; means adapted to mount said cap member on a vertical gate post for limited rotation less than 360° about a vertical axis; and locking means within the protected chamber to at times lock said cap member against rotation, said locking means including disconnectable linkage means mounted in the protected chamber and having at least one key-controlled removable link pin connection means, an interlocking element on the vertical gate post, and a retractable locking element matingly engageable with said interlocking element, said retractable locking element being connectable to said linkage means by use of a padlock.

2. A gate locking device comprising a cap member having a side opening adapted to receive the end of a horizontally swinging gate bar, bearing means to support said cap member for rotation on a vertical axis and including a stationary vertical post member, said bearing means having a rotational axis laterally offset from the vertical axis of the cap member and being located on the opposite side of said cap member vertical axis relative to said side opening, whereby the cap member is eccentrically rotatable relative to said cap member vertical axis and can move towards and away from the end of a gate bar receivable in said opening, and locking means to at times lock the cap member against rotation, said locking means being mounted on the cap member and being lockingly engageable with said vertical post member and contained within and covered by said cap member, said vertical post member being formed with an aperture and said locking means including a retractable locking element receivable in said aperture, said locking means comprising disconnectable linkage means mounted in said cap member with said locking element forming part of said linkage means, said locking means serving to inhibit rotation of said cap member so as to prevent escape of the end of the swinging gate bar by means of the interlocking of said retractable locking element in the aperture of the vertical post member, as said retractable locking element is supported by the disconnectable linkage means.

3. The gate locking device of claim 2, and wherein said linkage means comprises a plurality of link members forming a locked linkage, at least two adjacent link members of said linkage being provided with removable link pin connection means.

4. The gate locking device of claim 3, and wherein said link pin connection means comprises a key-controlled padlock having a shackle engaged through said two adjacent link members to form said link pin connection means.

5. A gate locking device comprising a cap member having a side opening adapted to receive the end of a horizontally swinging gate bar, bearing means to support said cap member for rotation on a vertical axis, said bearing means having a rotational axis laterally offset from the vertical axis of the cap member and being located on the opposite side of said cap member vertical axis relative to said side opening, whereby the cap member is eccentrically rotatable relative to said cap member vertical axis and can move towards and away from the end of a gate bar receivable in said side opening, and locking means to at times lock the cap member against rotation, said bearing means including a stationary post member for supporting said cap member, said locking means comprising interengageable link members lockable by means of a padlock and being lockingly engageable with the post member to prevent rotation of the cap member relative to the post, said locking means being retractable from engagement with the post member, and interengaging means on the cap member and post member for limiting rotation of the cap member relative to the post member when said locking means is retracted, and said bearing means including interengaging threads on the post member and cap member for rotatably connecting the cap member to the post member, said rotation-limiting means preventing the cap member from being detached from the post member when said locking means is retracted.

6. The gate locking device of claim 5, and wherein said rotation-limiting means comprises stop lug means mounted in the post member and depending projection means on the cap member engageable with said stop lug means responsive to rotation of the cap member on the post member.

7. The gate locking device of claim 6, and wherein said cap member has a horizontal floor member subjacent to said side opening and said depending projection means comprises an adjustable screw member threadedly support by said floor member.

8. The gate locking device of claim 7, and wherein said post member is formed with a slot receiving said locking means, wherein said stop lug means comprises a radially directed lug in the post member adjacent said slot, and wherein said adjustable screw member is located on the opposite side of the vertical axis of the post member relative to said lug when the cap member is in locked position.

9. A gate locking device comprising a rotatable cap member for mounting on a vertical support member in such a manner as to permit rotation of said cap member in an arc of less than 360° about a vertical axis, said cap member having an upper chamber and a lower chamber, said cap member having a side opening into said upper chamber adapted to receive the end of a horizontally extending and swingable gate bar, and locking means to inhibit rotation of said cap member so as to prevent escape of the end of the gate bar, said locking means being located largely in the lower chamber of said cap member and comprising a first interlocking member on the vertical support member, a second interlocking member for mating engagement with said first interlocking member, said second interlocking member comprising a retractable locking element, and disconnectable linkage elements mounted in the lower chamber of said cap member and engageable with said retractable locking element by means of a padlock.

10. A gate locking device of claim 9, wherein said first interlocking member on the vertical support member comprises an opening therein and wherein said second interlocking member for mating engagement with said first interlocking member comprises a male element for passage into said opening.

11. A gate locking device of claim 1, wherein said interlocking element on the vertical gate post is an opening extending into the vertical gate post, and wherein said retractable locking element is a male member for passage into said opening.

* * * * *